US005564822A

United States Patent [19]

Golden

[11] Patent Number: 5,564,822

[45] Date of Patent: Oct. 15, 1996

[54] LANTERN STAND

[76] Inventor: James A. Golden, 6625 W. 54th Pl., Arvada, Colo. 80002-3815

[21] Appl. No.: 453,197

[22] Filed: May 30, 1995

[51] Int. Cl.[6] ..... F21S 1/10

[52] U.S. Cl. ..... 362/431; 362/401; 362/415; 362/450

[58] Field of Search ..... 362/431, 153, 362/153.1, 447, 442, 415, 401, 450; 248/121, 176

[56] References Cited

U.S. PATENT DOCUMENTS

| | | | |
|---|---|---|---|
| 1,933,673 | 11/1933 | Krajnc | 248/121 |
| 2,926,875 | 3/1960 | Hoye | 248/121 |
| 3,995,796 | 12/1976 | Kline | 248/121 |
| 5,003,439 | 3/1991 | Yang | 362/153 |
| 5,124,899 | 6/1992 | Hale | 362/431 |

*Primary Examiner*—Denise L. Gromada
*Assistant Examiner*—Alfred Basichas
*Attorney, Agent, or Firm*—John P. Halvonik

[57] ABSTRACT

A lightweight, multi-unit lantern stand and system is described. The system uses hollow body tubular portions that are connected to one another through a system of threaded collars, compression nuts and compression rings. The finished structure will support a lantern at a distance above the ground. The insertion stake at the bottom of the assembly has a reinforced top and bottom section to facilitate hammering into the ground.

1 Claim, 1 Drawing Sheet

LANTERN STAND

BACKGROUND OF THE INVENTION

While there are other lantern stands in the prior art there are none known to applicant that have a stake portion that has a specially tapered head for hammering. Nor are there any that applicant is aware of that have hollowed tubular portions to eliminate excess weight of the stand.

FIELD OF THE INVENTION

The invention relates to the field of stands and supports and, in particular, to a multi unit stand for supporting lanterns. The lantern assembly comes with a special stake or post that has a reinforced head for insertion into the ground. The other parts of the assembly connect to one another through the use of threaded collars, compression nuts and compression rings.

It is believed that by using a hollow body tube system for the support elements of the structure will lead to a lightweight support stand that may find use in camping when the unit's light weight will make it easier to carry along on such trips.

PRIOR ART

While there are lantern stands in the prior art., there are no such stands that applicant is aware of that have this specially adapted stake post for driving into the ground and supporting such assemblies.

SUMMARY OF THE INVENTION

A lightweight, multi unit lantern stand and system is described. The system uses hollow body tubular portions that are connected to one another through a system of threaded collars, compression nuts, and compression rings. A system of threaded collars on the outside of the tubular portions is used to attach the various pieces to one another in order to erect the structure. The finished structure will support a lantern at a distance above the ground. The insertion stake at the bottom of the assembly has a reinforced top and bottom section for hammering into the ground.

It is among the objects of the invention to provide a lightweight and easy to transport lantern stand that may be disassembled when not in use.

It is an object to provide a stand for lanterns that can be easily hammered into the ground and has a specially shaped stake to accommodate this process.

Another object is to provide a lantern stand that is of lightweight nature so as to make it readily portable.

Another object is to make a lantern stand of hollow body portions so as to cut down on excess weight of the stand.

Another objective is to provide a lantern stand out of hollow body elements and having the insertion element having a reinforced head for hammering this element into the ground.

Another objective is to provide a lantern stand that allows the center of gravity of the lantern to be directly above the point at which the stake is driven into the ground in order to provide a properly balanced unit that can be driven straight into the ground.

Other objectives of the invention will be readily apparent to those skilled in the art once the invention has been described.

DESCRIPTION OF THE PREFERRED EMBODIMENT

Figure 1:
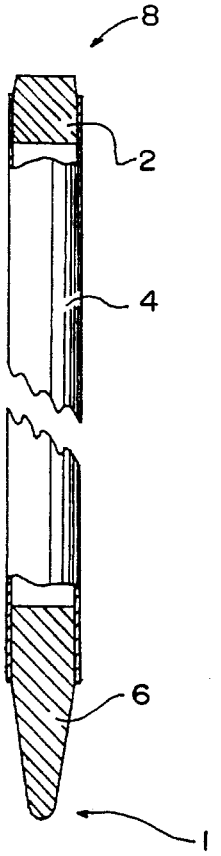
FIG. 1 View of the stake.
Figure 3:
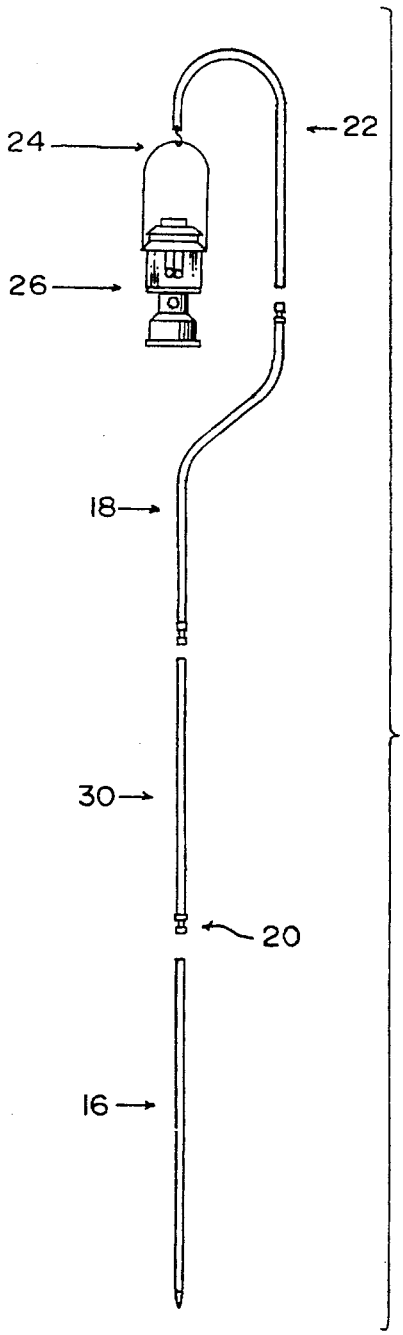
FIG. 3 Overall view of the invention.

The overall construction of the support assembly is as shown in FIG. 3, which is the lantern stand fully assembled. The sharpened end 1 of the stake portion 16 (see FIG. 1) is driven into the ground by hammering on the top of this portion. The sharpened end should be made of a solid metal material for strength. The suggested depth would, preferably, be about 11 inches. This distance can be varied in order to adjust the height of the lantern.

The stake portion is of generally tubular shape and has a special head 2, made of solid material, in order to allow it to be hammered into the ground by pounding with a hammer, or similar tool, on the top of this portion.

The top part of the head is flared inward at the top to make it ideal for hammering on the top without mushrooming. It has beveled edges 8 to facilitate this. This head portion 2 is of solid metal and extends from the top of the tubular portion and down for about ½–3 inches. The main part of the tubular section 4 is hollow to allow for ease of transport by the lightweight nature of this tubular part. The preferred length of the stake would be at least twelve inches. With the exception of the pointed tip and the solid top, the rest of the stake member is hollow.

Figure 2:
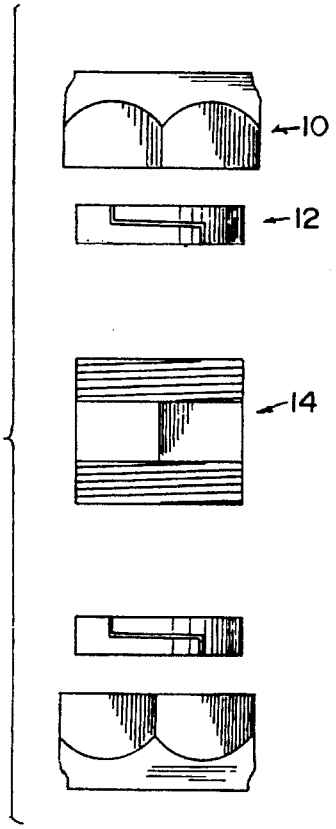
FIG. 2 View of the nut, ring, and collar.

Other support members, such as off set portion 18 (see figure 3), may be attached to one another by means of threaded collars 14 and compression nuts 10 and compression rings 12 (see FIG. 2). The collars fit over the ends of the tubular portions. One collar can fit over two such ends, such as the bottom of the offset portion and the top of the stake portion. The threaded couplings are used as clamps. The compression nuts are attached to complimentary threads on the outer side of the threaded collars.

The offset member should have an angled portion so that when placed in connection with the stake 16 (see FIG. 3), at least a portion of 18 will not be co-linear with 16. That is, 18 will provide a piece that will be offset from the line that part 16 lies along. The lantern will then be able to hang in the area above 18, and the center of gravity of the lantern will be directly above the stake 16. The off set portion should prevent the stand from tending to lean.

The top structural member 22 has a curved shape and has a hook 24 or eyelet at one end. The hook is used to support the lantern 26 as shown.

The support pieces should be made of a thin wall material such as metal, for its combination of light weight and strength. Once the stake 16 is driven into the ground, the unit can be assembled and disassembled without tools.

The stake is made of thin wall conduit also, but is believed to be unique because it has a solid stub welded into each end for added strength and durability. The use of a hollow body portion throughout the stake is believed to reduce the weight of the unit and facilitate transport.

The support members 16, 18, 22 should be joined together with the aforementioned collars in order to make the unit compact enough to fit in any vehicle, including small motorcycle trailers. There should be at least three such members, the stake, the offset portion and the curved portion at the top of the assembly. Additional straight tubular members 30, may be added to the support assembly in order to increase the height of the unit.

This member is attached by the preferred method of collars 20 and threads on the tubular structural portions.

I claim:

1. A tubular support structure assembly for support of lanterns, said assembly comprising: at least three tubular portions including an insertion portion, an offset portion and a curved portion, each of said portions of tubular construction and each being of hollow body construction, said insertion portion of relatively straight construction and having a top portion that is of solid metal and having an end portion that is pointed, an area of said insertion portion between said end portion and said top portion being of hollow construction, said offset portion having two ends and an angled section between said ends, so that said angled section is non co-linear with said insertion portion when said offset portion is connected to said insertion portion, said curved portion having an end with a means to support a lantern and having a curvature such that when said tubular portions are connected to one another said end of said curved portion will be co-linear with said insertion portion, said assembly having at least two threaded collars for joining said tubular portions to one another.

* * * * *